US007683872B2

(12) United States Patent
Jan et al.

(10) Patent No.: US 7,683,872 B2
(45) Date of Patent: Mar. 23, 2010

(54) DISPLAY DRIVING APPARATUS AND MULTI-LINE INVERSION DRIVING METHOD THEREOF

(75) Inventors: Chung-Jr Jan, Taipei County (TW); Che-Li Lin, Taipei (TW)

(73) Assignee: Novatek Microelectronics Corp., Hsinchu (TW)

( * ) Notice: Subject to any disclaimer, the term of this patent is extended or adjusted under 35 U.S.C. 154(b) by 921 days.

(21) Appl. No.: 11/457,467

(22) Filed: Jul. 14, 2006

(65) Prior Publication Data

US 2007/0262941 A1 Nov. 15, 2007

(30) Foreign Application Priority Data

May 10, 2006 (TW) ..... 95116504 A

(51) Int. Cl.
*G09G 3/36* (2006.01)

(52) U.S. Cl. ..... 345/96

(58) Field of Classification Search ..... 345/96–100
See application file for complete search history.

(56) References Cited

U.S. PATENT DOCUMENTS

| | | | | |
|---|---|---|---|---|
| 6,342,876 | B1 * | 1/2002 | Kim | 345/87 |
| 2003/0038766 | A1 * | 2/2003 | Lee et al. | 345/87 |
| 2006/0290644 | A1 * | 12/2006 | Kim | 345/100 |

* cited by examiner

*Primary Examiner*—Richard Hjerpe
*Assistant Examiner*—Carolyn R Edwards
(74) *Attorney, Agent, or Firm*—Jianq Chyun IP Office

(57) ABSTRACT

A display driving apparatus and a multi-line inversion driving method thereof are provided. The apparatus includes a gate driver, a source driver, a gate enabling unit and a line polarity signal unit. Every time after a plurality of scan lines is turned on, the source driver inverts the polarity of the sub pixel driving signal according to a line polarity signal output by the line polarity signal unit. Thereby, the polarity inversion operating frequency of the sub pixel driving signal is lowered to reduce the power consumption of the source driver.

25 Claims, 15 Drawing Sheets

| | $D_1$ | $D_2$ | $D_3$ | $D_4$ | $D_5$ | $D_6$ | $D_7$ | $D_8$ |
|---|---|---|---|---|---|---|---|---|
| $S_1$ | + | − | + | − | + | − | + | − |
| $S_2$ | − | + | − | + | − | + | − | + |
| $S_3$ | + | − | + | − | + | − | + | − |
| $S_4$ | − | + | − | + | − | + | − | + |
| $S_5$ | + | − | + | − | + | − | + | − |
| $S_6$ | − | + | − | + | − | + | − | + |
| $S_7$ | + | − | + | − | + | − | + | − |
| $S_8$ | − | + | − | + | − | + | − | + |

FIG. 1A (PRIOR ART)

| | $D_1$ | $D_2$ | $D_3$ | $D_4$ | $D_5$ | $D_6$ | $D_7$ | $D_8$ | $D_9$ | $D_{10}$ | $D_{11}$ | $D_{12}$ | $D_{13}$ | $D_{14}$ | $D_{15}$ | $D_{16}$ |
|---|---|---|---|---|---|---|---|---|---|---|---|---|---|---|---|---|
| $S_1$ | + | − | + | − | + | − | + | − | + | − | + | − | + | − | + | − |
| $S_2$ | + | − | + | − | + | − | + | − | + | − | + | − | + | − | + | − |
| ⋮ | | | | ⋮ | | | | | | | | | ⋮ | | | |
| $S_N$ | + | − | + | − | + | − | + | − | + | − | + | − | + | − | + | − |
| $S_{N+1}$ | − | + | − | + | − | + | − | + | − | + | − | + | − | + | − | + |
| $S_{N+2}$ | − | + | − | + | − | + | − | + | − | + | − | + | − | + | − | + |
| ⋮ | | | | ⋮ | | | | | | | | | ⋮ | | | |
| $S_{2N}$ | − | + | − | + | − | + | − | + | − | + | − | + | − | + | − | + |
| $S_{2N+1}$ | + | − | + | − | + | − | + | − | + | − | + | − | + | − | + | − |
| $S_{2N+2}$ | + | − | + | − | + | − | + | − | + | − | + | − | + | − | + | − |
| ⋮ | | | | ⋮ | | | | | | | | | ⋮ | | | |
| $S_{3N}$ | + | − | + | − | + | − | + | − | + | − | + | − | + | − | + | − |
| $S_{3N+1}$ | − | + | − | + | − | + | − | + | − | + | − | + | − | + | − | + |
| $S_{3N+2}$ | − | + | − | + | − | + | − | + | − | + | − | + | − | + | − | + |
| ⋮ | | | | ⋮ | | | | | | | | | ⋮ | | | |
| $S_M$ | − | + | − | + | − | + | − | + | − | + | − | + | − | + | − | + |

Frame T

FIG. 7

| | $D_1$ | $D_2$ | $D_3$ | $D_4$ | $D_5$ | $D_6$ | $D_7$ | $D_8$ | $D_9$ | $D_{10}$ | $D_{11}$ | $D_{12}$ | $D_{13}$ | $D_{14}$ | $D_{15}$ | $D_{16}$ |
|---|---|---|---|---|---|---|---|---|---|---|---|---|---|---|---|---|
| $S_1$ | − | + | − | + | − | + | − | + | − | + | − | + | − | + | − | + |
| $S_2$ | − | + | − | + | − | + | − | + | − | + | − | + | − | + | − | + |
| ⋮ | | | | ⋮ | | | | | | | | | ⋮ | | | |
| $S_N$ | − | + | − | + | − | + | − | + | − | + | − | + | − | + | − | + |
| $S_{N+1}$ | + | − | + | − | + | − | + | − | + | − | + | − | + | − | + | − |
| $S_{N+2}$ | + | − | + | − | + | − | + | − | + | − | + | − | + | − | + | − |
| ⋮ | | | | ⋮ | | | | | | | | | ⋮ | | | |
| $S_{2N}$ | + | − | + | − | + | − | + | − | + | − | + | − | + | − | + | − |
| $S_{2N+1}$ | − | + | − | + | − | + | − | + | − | + | − | + | − | + | − | + |
| $S_{2N+2}$ | − | + | − | + | − | + | − | + | − | + | − | + | − | + | − | + |
| ⋮ | | | | ⋮ | | | | | | | | | ⋮ | | | |
| $S_{3N}$ | − | + | − | + | − | + | − | + | − | + | − | + | − | + | − | + |
| $S_{3N+1}$ | + | − | + | − | + | − | + | − | + | − | + | − | + | − | + | − |
| $S_{3N+2}$ | + | − | + | − | + | − | + | − | + | − | + | − | + | − | + | − |
| ⋮ | | | | ⋮ | | | | | | | | | ⋮ | | | |
| $S_M$ | + | − | + | − | + | − | + | − | + | − | + | − | + | − | + | − |

Frame T+1

FIG. 8

DISPLAY DRIVING APPARATUS AND MULTI-LINE INVERSION DRIVING METHOD THEREOF

CROSS-REFERENCE TO RELATED APPLICATION

This application claims the priority benefit of Taiwan application serial no. 95116504, filed May 10, 2006. All disclosure of the Taiwan application is incorporated herein by reference.

BACKGROUND OF THE INVENTION

1. Field of Invention

The present invention relates to a display driving apparatus, and more particularly, to a display driving apparatus applicable for driving a liquid crystal display panel and a multi-scan line inversion driving method thereof.

2. Description of Related Art

Thin film transistor liquid crystal displays (TFT LCDs) have become one of the main streams of flat panel displays (FPDs), and source drivers are among the major power consumption for TFT LCD driving apparatuses.

At present, large panels are generally driven by dot inversion, and the largest power consumption thereof is related to the polarity inversion frequency of the scan lines, wherein the greater the frequency is, the more power will be consumed. FIG. 1A is a polarity view of sub-pixels driven by dot inversion according to a conventional art. Referring to FIG. 1A, each grid represents a sub-pixel, and the symbol in the grid represents the polarity of the sub-pixel when driven (+ represents a positive polarity drive, – represents a negative polarity drive), wherein the sub-pixel driving polarities of two adjacent scan lines are opposite (for example, the polarities of scan line $S_1$ and scan line $S_2$ are opposite). During the period that two scan lines are turned on sequentially, the polarity of each of the data lines $D_1$~$D_8$ must be switched between positive and negative polarities. Every time when a polarity inversion is performed, it represents that each of the data lines $D_1$~$D_8$ has a larger voltage swing, so the source driver needs more power to implement dot inversion. In other words, the faster the polarity inversion frequency of the sub-pixels in the data lines $D_1$~$D_8$ is, the more power the source driver consumes.

FIG. 1B is a timing view of single-line inversion driving signals according to the conventional art. Referring to FIG. 1B, each positive half-period +POL or negative half-period –POL of a line polarity signal POL corresponds to a pulse signal of a gate clock signal GCLK, a latch delay signal of a source data latch signal LD and an enabling signal pulse of a gate enabling signal GES. The negative edge of the source data latch signal LD represents the time for the source driver to start outputting a sub-pixel driving signal. The time length of the gate enabling signal GES being at a low level represents the turn-on time length of the corresponding scan line. Therefore, the longer the gate enabling signal GES is at a low level, or the shorter the delay time of the source data latch signal LD is, the longer the sub-pixels of the corresponding scan line is charged. The line polarity signal POL is inverted every time after a scan line is turned on, i.e., the polarity of the data lines $D_1$~$D_8$ must be switched between positive and negative polarities in the period when any two adjacent scan lines are turned on. As such, the power consumption of the source driver becomes greater.

Of course, the gate enabling signal GES can also adopt a time length of high level to represent the turn-on time length of the corresponding scan lines. Referring to FIG. 1C, the longer the gate enabling signal GES is at a high level, or the shorter the delay time of the source data latch signal LD is, the longer the sub-pixels of the corresponding scan line is charged. Similarly, according to the timing of the line polarity POL, the higher polarity inversion frequency for the data lines $D_1$~$D_8$ during the period when any two adjacent scan lines are turned on, the more power the source driver consumes.

With the coming of a high pixel era, in order to maintain the frame quality, a higher polarity inversion frequency for sub-pixels is needed, which may cause greater power consumption.

SUMMARY OF THE INVENTION

An objective of the present invention is to provide a display driving apparatus, which adopts a multi-line inversion driving method to lower the polarity switching frequency for the sub-pixel driving signal output by the source driver, thereby reducing the power consumption of the source driver.

Another objective of the present invention is to provide a multi-line inversion driving method, wherein every time after a plurality of scan lines is turned on sequentially, the polarity of the sub-pixel driving signal is inverted, so as to reduce the power consumption of the source driver.

Another objective of the present invention is to provide a multi-line inversion driving method, wherein when the polarity of the sub-pixel driving signal is inverted, the turn-on time for each scan line is adjusted, so as to avoid obtaining a frame with non-uniform brightness due to different charging times.

Another objective of the present invention is to provide a display, wherein the switching frequency of the data line between positive and negative polarities is lowered, so as to reduce the power consumption of the display driving apparatus, and the turn-on time for each scan line is adjusted, thereby solving the problem of a frame with non-uniform brightness due to different charging times of the sub-pixels.

To fulfill the above and other objectives, the present invention provides a display driving apparatus suitable for driving a liquid crystal display panel, wherein the liquid crystal display panel includes M scan lines, M is a positive integer, and each scan line corresponds to a plurality of sub-pixels. The above-mentioned display driving apparatus comprises a gate driver, a source driver, a gate enabling unit and a line polarity signal unit. The gate enabling unit is electrically connected to the gate driver, and the line polarity signal unit is electrically connected to the source driver.

The gate driver sequentially turns on the scan lines in the liquid crystal display panel, wherein the turn-on time for each scan line is controlled by the gate enabling signal output by the gate enabling unit. The source driver outputs a plurality of sub-pixel driving signals for driving the sub-pixels. The sub-pixel driving signal is of positive or negative polarity. Every time after N scan lines are turned on by the gate driver, the source driver inverts the polarity of the output sub-pixel driving signal once, wherein N is a positive integer, $2<N\leqq M$.

The period that every N scan lines are sequentially turned on by the gate driver is an N-line period. In each N-line period, a first turn-on time of the first scan line is not equal to a second turn-on time of the second scan line, wherein the first turn-on time or the second turn-on time is controlled by a plurality of latch signals output by the latch signal unit. The value of N is determined by the line polarity signal output by the line polarity signal unit. The above-mentioned gate enabling signal respectively adjusts the turn-on time for each scan line during the polarity inversion period of the sub-pixel driving signals, thereby solving the unequal charging problem for each sub-pixel via adjusting the charging time.

From another aspect, the present invention further provides a multi-line inversion driving method for driving a liquid crystal display panel. The liquid crystal display panel comprises M scan lines, wherein M is a positive integer, and each scan line corresponds to a plurality of sub-pixels. The multi-line inversion driving method comprises: first, sequentially turning on the scan lines in the liquid crystal display panel and controlling the turn-on time for each scan line; then, outputting a plurality of sub-pixel driving signals for driving the sub-pixels, wherein the sub-pixel driving signals are either of positive polarity or negative polarity; next, inverting the polarity of the output sub-pixel driving signals after each N-line period which is a period that every N scan lines is turned on sequentially, wherein N is a positive integer, $2<N\leqq M$. Other details of the method have been shown in the above illustration of the display driving apparatus and can be easily deduced by those skilled in the art accordingly, so they will not be described in detail herein.

Further, the present invention provides a display, which comprises a liquid crystal display panel and the above-mentioned display driving apparatus. The liquid crystal display panel comprises M scan lines, wherein M is a positive integer, and each scan line corresponds to a plurality of sub-pixels. The display driving apparatus sequentially turns on the scan lines in the liquid crystal panel, and correspondingly outputs a plurality of sub-pixel driving signals for driving the aforementioned sub-pixels. The sub-pixel driving signals are either of positive polarity or negative polarity. Every time N scan lines being sequentially turned on by the display driving apparatus is an N-line period, and after each N-line period, the display driving apparatus inverts the polarity of the sub-pixel driving signal once, wherein N is a positive integer, $2<N\leqq M$.

As the present invention adopts a multi-line inversion driving method, after a plurality of scan lines is sequentially turned on, the polarities of the sub-pixel driving signals are inverted once, so as to lower the inversion frequency of the data lines between positive and negative polarities, thereby reducing the power consumption of the source driver. Further, the turn-on time for each scan line is adjusted to make each sub-pixel obtain a sufficient charging time during the polarity inversion of the sub-pixel driving signal, thereby avoiding the phenomenon of non-uniform brightness.

In order to make the aforementioned and other objects, features and advantages of the present invention comprehensible, preferred embodiments accompanied with figures are described in detail below.

BRIEF DESCRIPTION OF THE DRAWINGS

FIG. 1A is a polarity view of sub-pixels driven by dot inversion according to a conventional art.

FIG. 7 is a schematic view of a multi-line inversion driving method according to the present embodiment.

FIG. 8 is a schematic view of the multi-line inversion driving method applied to the second frame according to the present embodiment.

DESCRIPTION OF EMBODIMENTS

Figure 1B:
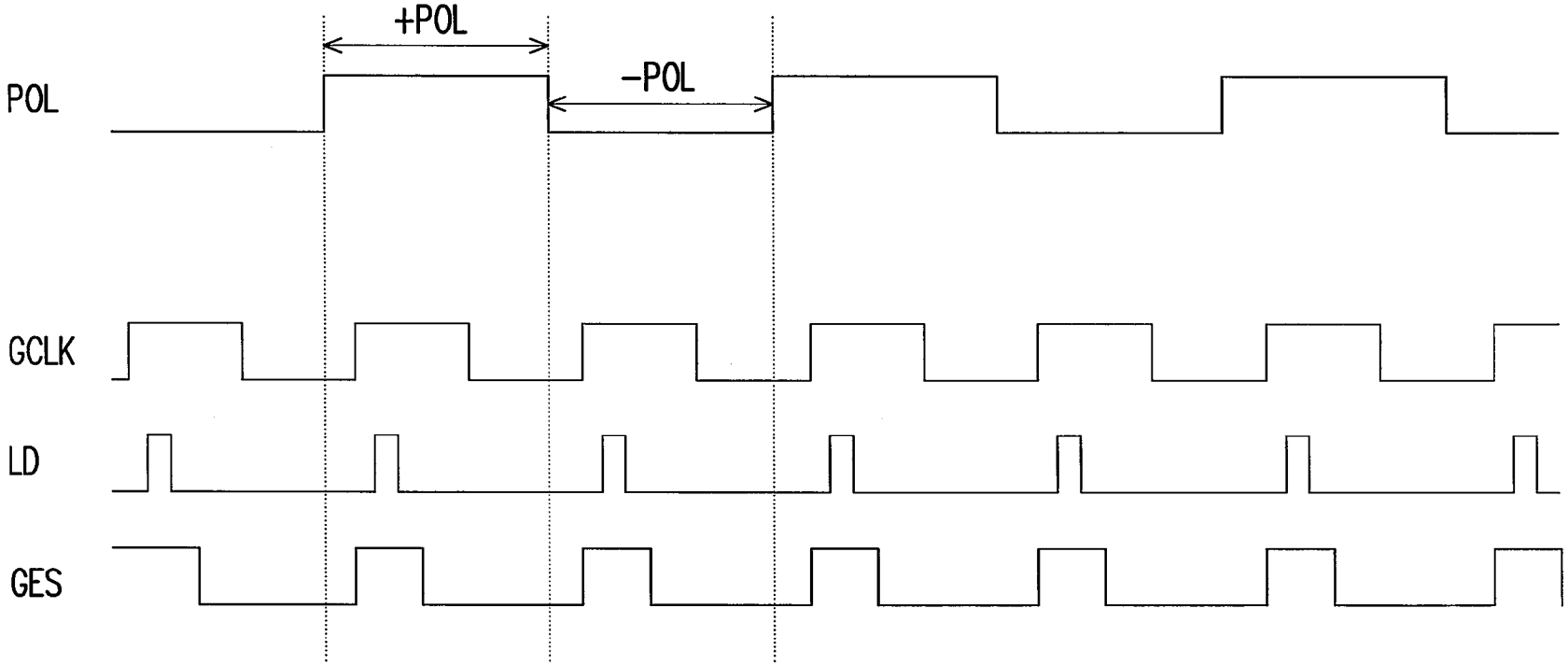
FIG. 1B (PRIOR ART)
FIG. 1B is a timing view of single-line inversion driving signals according to the conventional art.
Figure 1C:
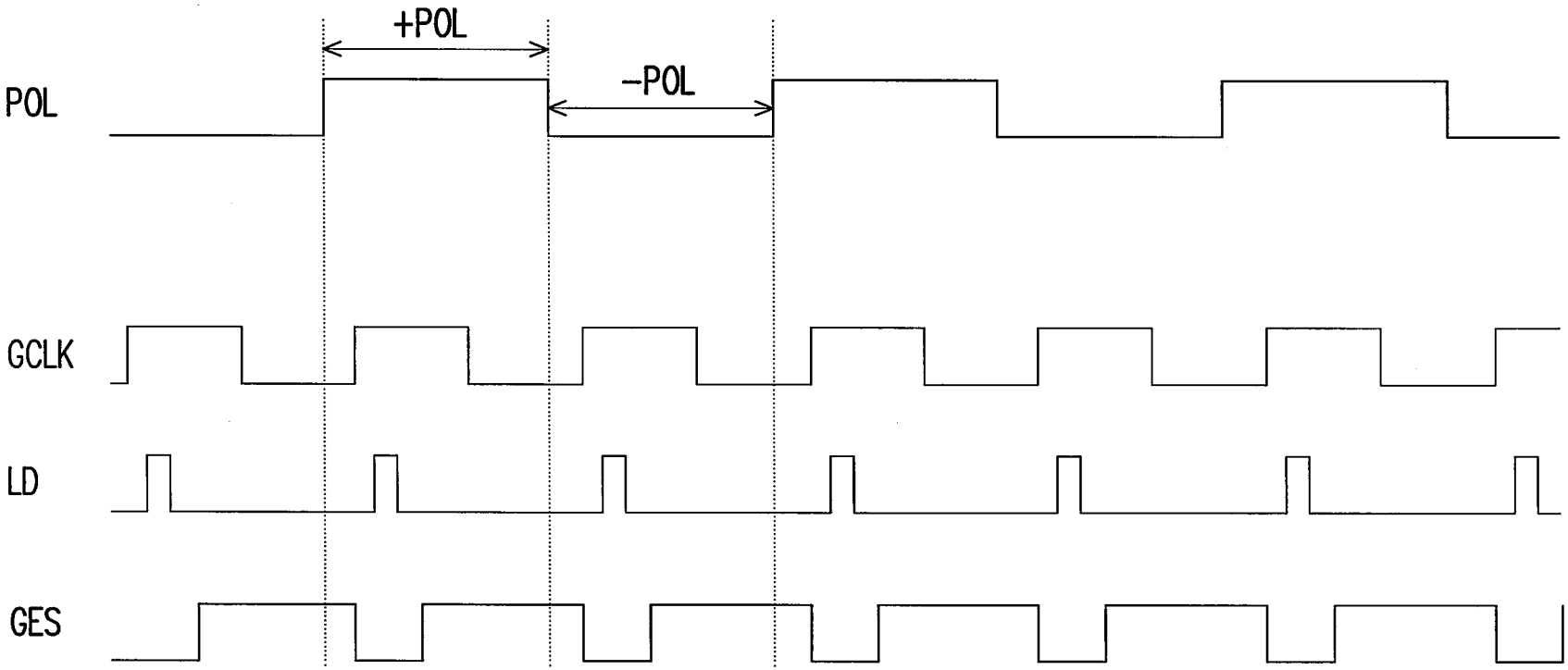
FIG. 1C (PRIOR ART)
FIG. 1C a timing view of single-line inversion driving signals according to the conventional art.
Figure 2:
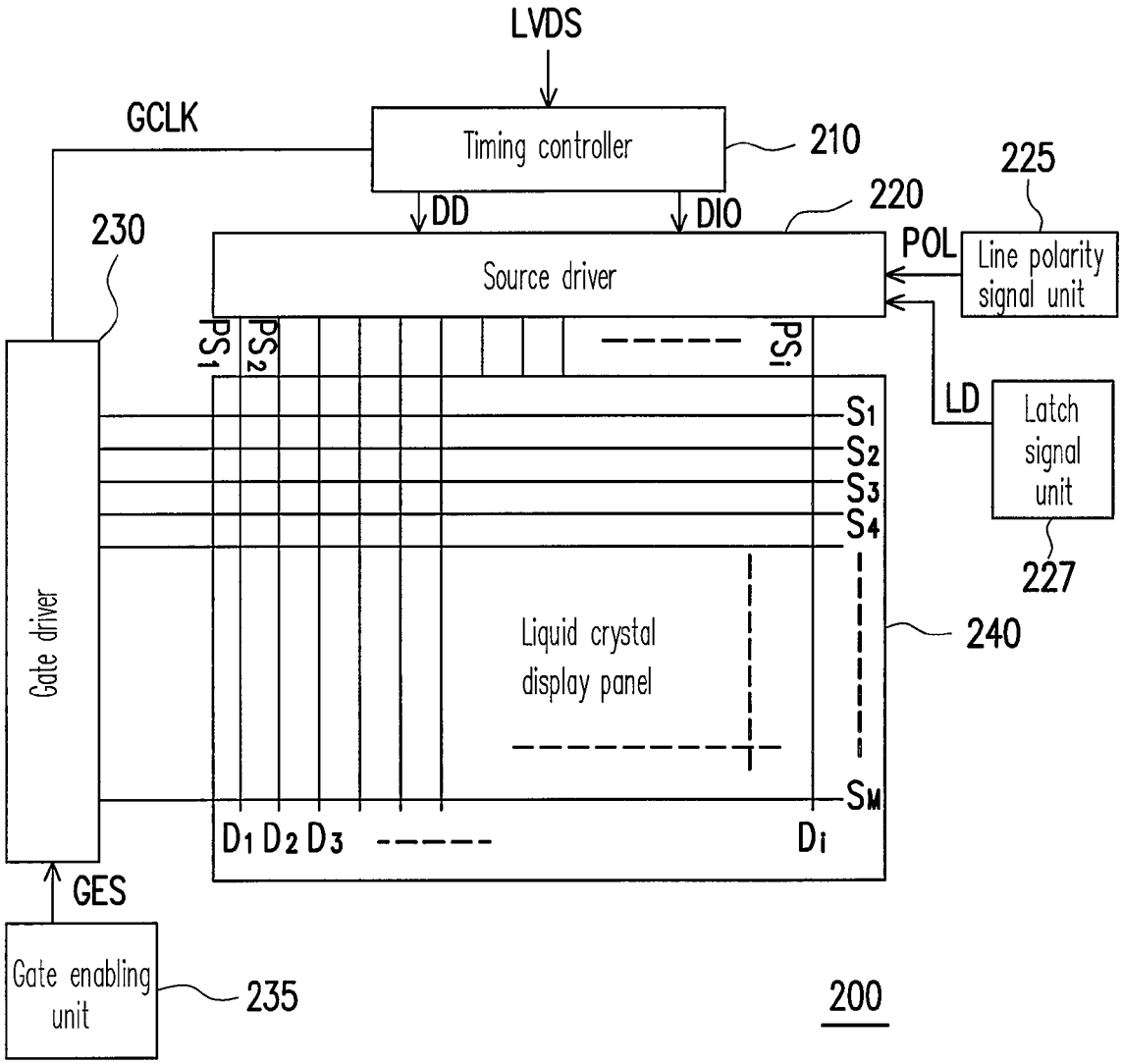
FIG. 2 is a structural view of a display according to an embodiment of the present invention.

FIG. 2 is an architectural view of a display according to an embodiment of the present invention. As shown in FIG. 2, the display of the present embodiment comprises a timing controller 210, a source driver 220, a line polarity signal unit 225, a latch signal unit 227, a gate driver 230, a gate enabling unit 235 and a liquid crystal display panel 240.

The timing controller 210 is electrically connected to the gate driver 230 and outputs a gate clock signal GCLK for controlling the output timing of the gate driver 230. The gate driver 230 is electrically connected to scan lines $S_1$~$S_M$ in the liquid crystal display panel 240. Each of the scan lines $S_1$~$S_M$ has a plurality of sub-pixels, wherein M is a positive integer. The gate enabling unit 235 is electrically connected to the gate driver 230, and provides a gate enabling signal GES to the gate driver 230 for controlling the gate driver 230 to determine the turn-on time for each scan line.

The timing controller 210 is further electrically connected to the source driver 220. The timing controller 210 outputs a source shift signal DIO, and the latch signal unit 227 outputs a source data latch signal LD for controlling the data latch timing and the output timing of the source driver 220. Therefore, the source driver 220 latches digital data DD according to timing, and inverts the latched data and outputs it as sub-pixel driving signals $PS_1$~$PS_i$. The source driver 220 is respectively electrically connected to data lines $D_1$~$D_i$ on the liquid crystal display panel 240, and respectively outputs the sub-pixel driving signals $PS_1$~$PS_i$ to the data lines $D_1$~$D_i$ connected thereto (i is a positive integer). The line polarity signal unit 225 is electrically connected to the source driver 220, and outputs a line polarity signal POL to the source driver 220 for controlling the source driver 220 to determine the polarity inversion frequency of the sub-pixel driving signals $PS_1$~$PS_i$, i.e., the polarity inversion frequency of the data lines $D_1$~$D_i$.

The gate driver 230 sequentially scans the scan lines $S_1$~$S_M$ in the liquid crystal display panel 240, and adjusts the turn-on time for the scan lines $S_1$~$S_M$ according to the length of the enabling period on the gate enabling signal GES. When one of the scan lines $S_1$~$S_M$ is turned on by the gate driver 230, the source driver 220 outputs corresponding sub-pixel driving signals $PS_1$~$PS_i$ to the data lines $D_1$~$D_i$ for charging the sub-pixels on the scan line $S_1$~$S_M$ that is turned on. The sub-pixel driving signals $PS_1$~$PS_i$ are either of positive polarity or negative polarity. According to the line polarity signal POL, the period that every N scan lines are sequentially turned on by the gate driver 230 is an N-line period. After each N-line period, the source driver 220 inverts the polarities of the sub-pixel driving signals $PS_1$~$PS_i$ once, wherein N is a positive integer, $2<N\leqq M$, and the value of N is determined by the line polarity signal POL. In other words, every time after N scan lines are turned on, the source driver 220 inverts the polarities of the sub-pixel driving signals $PS_1$~$PS_i$ once.

In other words, when the line polarity signal POL is transformed, the source driver 220 inverts the polarities of the sub-pixel driving signals $PS_1$~$PS_i$. If the sub-pixel driving signals $PS_1$~$PS_i$ are of positive polarity, the data lines $D_1$~$D_i$ are under positive polarity drive; while if the sub-pixel driving signals $PS_1$~$PS_i$ are of negative polarity, the data lines $D_1$~$D_i$ are under negative polarity drive. When the polarities of the data lines $D_1$~$D_i$ are inverted between positive and negative polarity drive, the voltage swing thereof is large and the power consumption is great. In the present embodiment, the polarity inversion of the data lines $D_1$~$D_i$ only occurs when the line polarity signal POL is transformed, so the polarity inversion frequency of the data lines $D_1$~$D_i$ is greatly lowered, thereby reducing the power consumption of the source driver 220.

Figure 3:
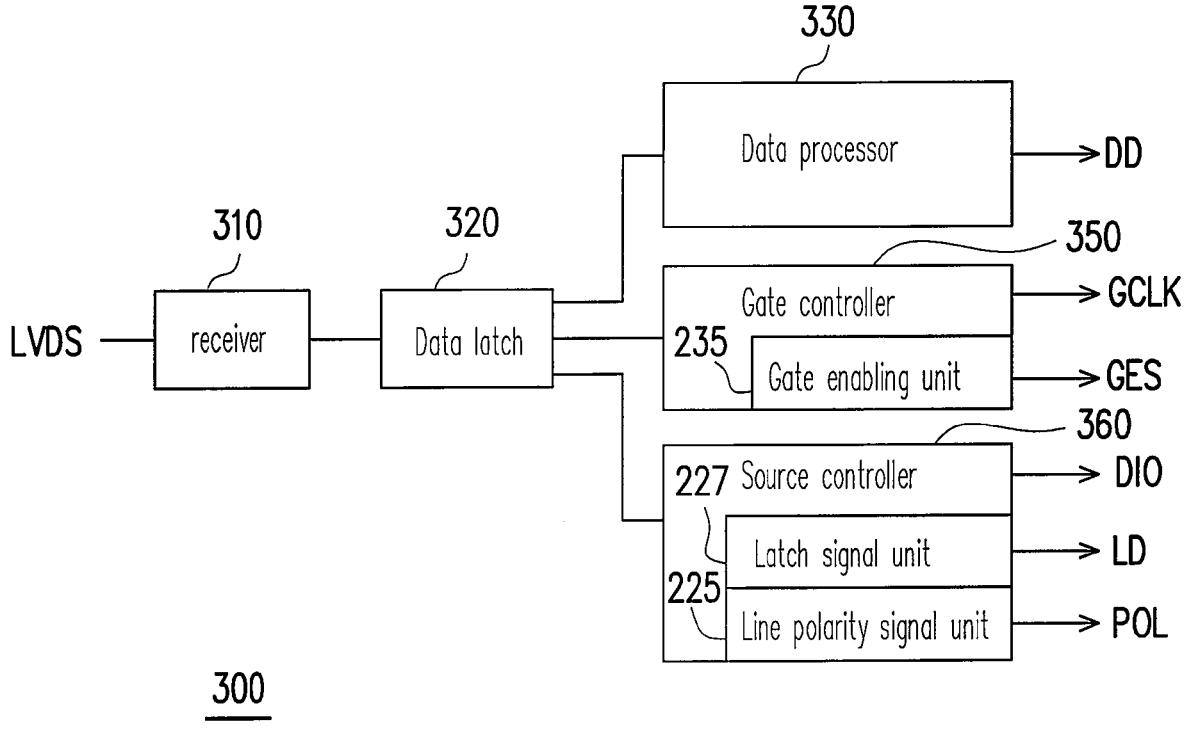
FIG. 3 is a block diagram of a timing controller according to the present embodiment.

In another embodiment of the present invention, the gate enabling unit 235, the line polarity signal unit 225 and the latch signal unit 227 can also be integrated into the timing controller 210. FIG. 3 is a block diagram of a timing controller according to the present embodiment. A timing controller 300 comprises a receiver 310, a data latch 320, a data processor 330, a gate controller 350 and a source controller 360. The gate controller 350 comprises the gate enabling unit 235, and the source controller 360 comprises the line polarity signal unit 225 and the latch signal unit 227. The receiver 310 is electrically connected to the data latch 320. The data latch 320 is respectively electrically connected to the gate controller 350 and the source controller 360.

The receiver 310 receives a low voltage differential signal LVDS and registers data via the data latch 320. The data processor 330 receives the data registered by the data latch 320 to provide the digital data DD required by the source driver. According to the data registered in the data latch 320, the gate enabling unit 235 in the gate controller 350 outputs a gate enabling signal GES to the gate driver 230 for controlling the gate driver 230 to determine the turn-on time of the scan lines $S_1$~$S_M$. According to the data registered in the data latch 320, the gate controller 350 outputs a gate clock signal GCLK to the gate driver 230 for controlling the signal shift in the gate driver 230. According to the data registered in the data latch 320, the line polarity signal unit 225 in the source controller 360 outputs a line polarity signal POL to the source driver 220, and the period for the source driver 220 to invert the polarities of the sub-pixel driving signals $PS_1$~$PS_i$ is controlled by the line polarity signal POL. Meanwhile, according to the data registered in the data latch 320, the source controller 360 further outputs a source shift signal DIO and a source data latch signal LD to the source driver 220 for controlling the data latch and data output in the source driver 220, wherein the source data latch signal LD is output by the latch signal unit 227. In another embodiment of the present invention, the gate enabling unit 235, the line polarity signal unit 225 and the latch signal unit 227 do not have to be integrated into the gate controller 350 and the source controller 360, but can be directly integrated into the timing controller 300 as independent circuit units.

Figure 4A:
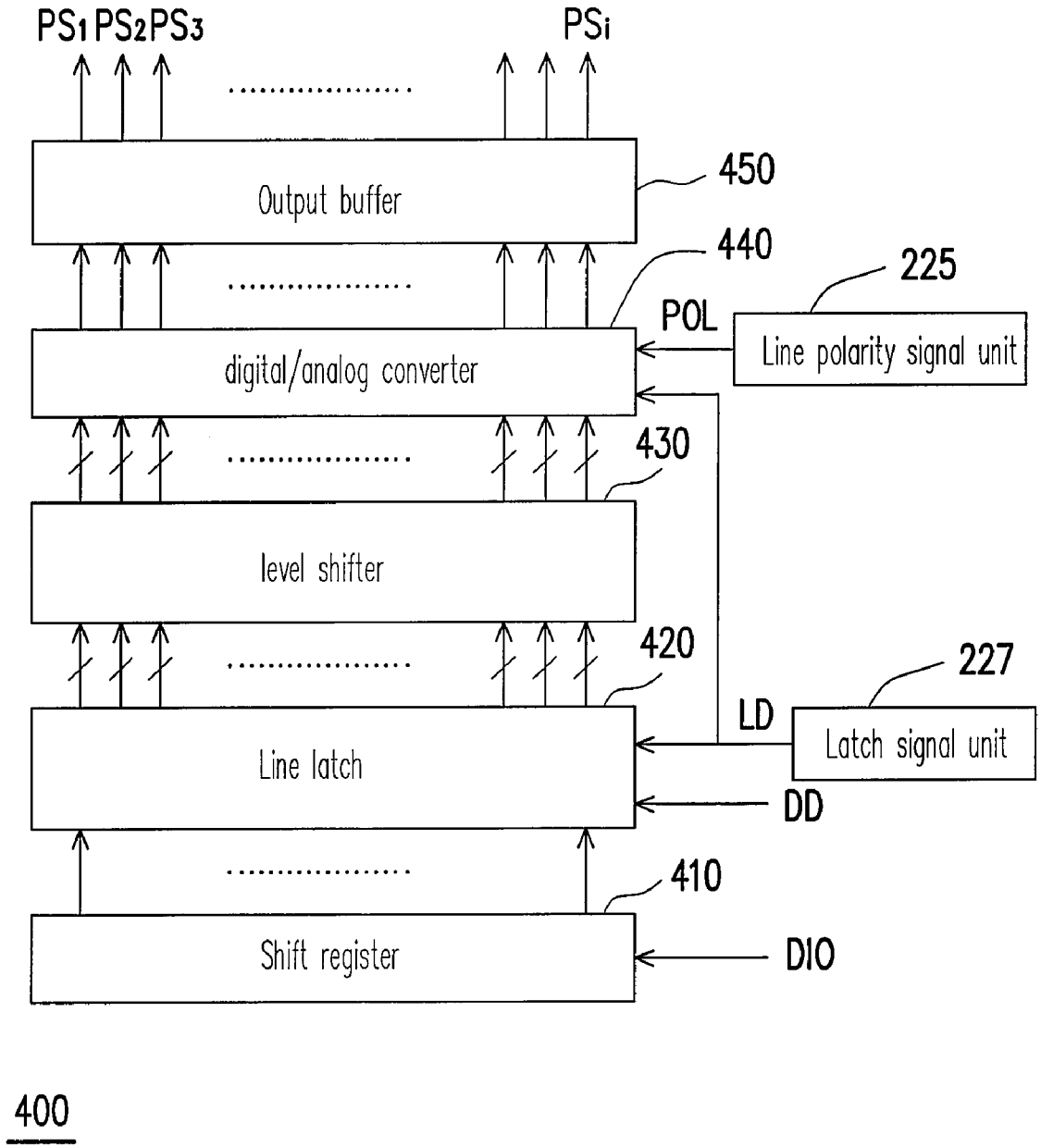
FIG. 4A is a block diagram of a source driver according to another embodiment of the present invention.
Figure 5A:
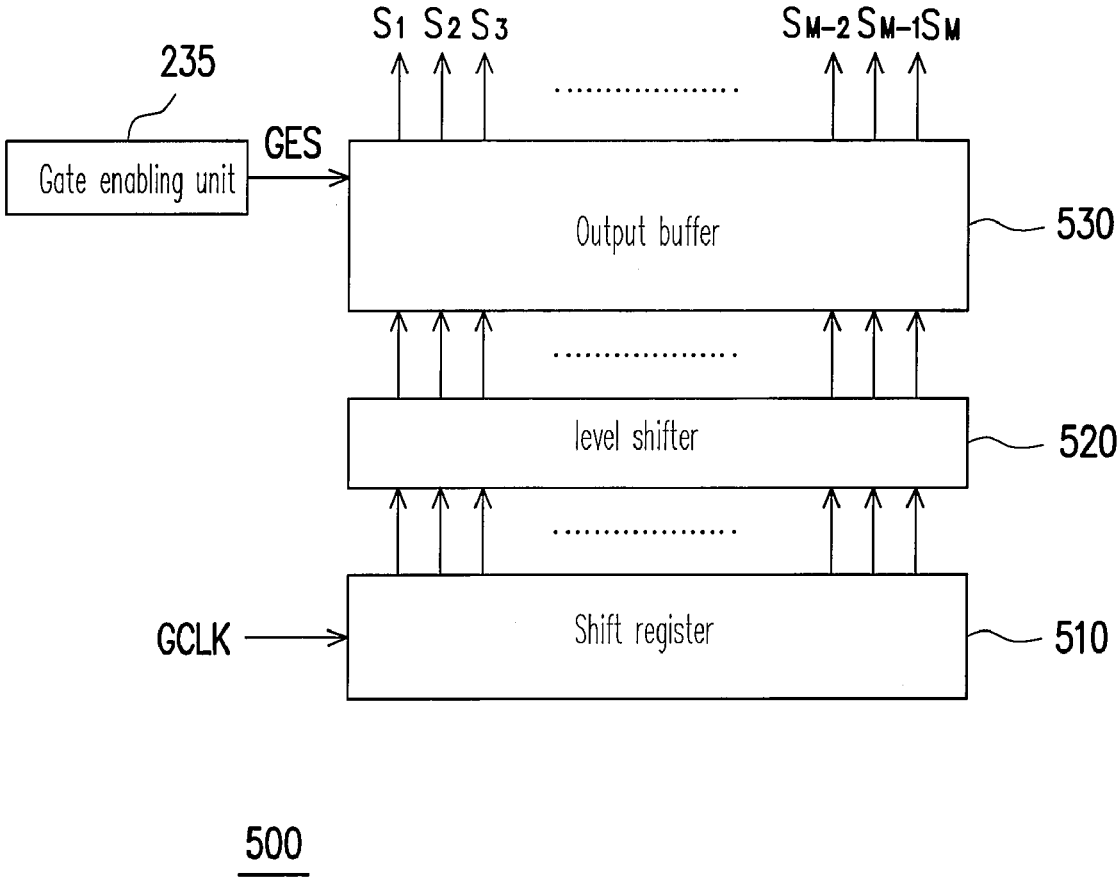
FIG. 5A is a block diagram of a gate driver according to another embodiment of the present invention.

In another embodiment of the present invention, the gate enabling unit 235, the line polarity signal unit 225 and the latch signal unit 227 are all independent circuits mainly used for outputting the gate enabling signal GES, the line polarity signal POL and the source data latch signal LD. The positions of the gate enabling unit 235, the line polarity signal unit 225 and the latch signal unit 227 are not limited, and they can be integrated into the gate driver 230 and the source driver 220, as shown in FIGS. 4A and 5A. FIG. 4A is a block diagram of a source driver according to another embodiment of the present invention. FIG. 5A is a block diagram of a gate driver according to another embodiment of the present invention.

Referring to FIG. 4A, a source driver 400 comprises a shift register 410, a line latch 420, a level shifter 430, a digital/analog converter 440, an output buffer 450, a line polarity signal unit 225 and a latch signal unit 227. The line polarity signal unit 225 is electrically connected to the digital/analog converter 440. The line latch 420 is electrically connected between the level shifter 430 and the shift register 410. The digital/analog converter 440 is electrically connected between the output buffer 450 and the level shifter 430.

The shift register 410 gradually shifts the received source shift signal DIO for sequentially generating a plurality of latch triggering signals with different timings. Then, each channel latch in the line latch 420 sequentially latches the digital data DD provided by the timing controller 210 according to the latch triggering signals output by the shift register 410. After each channel latch in the line latch 420 finishes the data latching, the line latch 420 further outputs the latched data in each channel latch according to the timing of the source data latch signal LD output by the latch signal unit 227. The data output by the line latch 420 is output as sub-pixel driving signals $PS_1$~$PS_i$ via the level shifter 430, the digital/analog converter 440 and the output buffer 450. The digital/analog converter 440 outputs the sub-pixel driving signals $PS_1$~$PS_i$ according to the timing of the source data latch signal LD provided by the latch signal unit 227, and controls the source driver 400 to determine the charging time for the sub-pixels of each scan line according to the changes in the timing of the source data latch signal LD. Moreover, the digital/analog converter 440 also determines the polarities of the sub-pixel driving signal $PS_1$~$PS_i$ respectively according to the line polarity signal POL output by the line polarity signal unit 225.

When the line polarity signal POL generates a trigger (for example, a positive edge trigger or a negative edge trigger), the source driver 400 inverts the polarities of the sub-pixel driving signals $PS_1$~$PS_i$. During the period for the line polarity signal POL to generate two adjacent triggers, the gate driver 230 sequentially turns on N scan lines (N is a positive integer, and $2<N\leqq M$), wherein the value of N is determined by the trigger period of the line polarity signal POL. In the present embodiment, the period that N scan lines are sequentially turned on is an N-line period, which is the same as the period for the line polarity signal POL to generate two adjacent triggers.

Figure 4B:
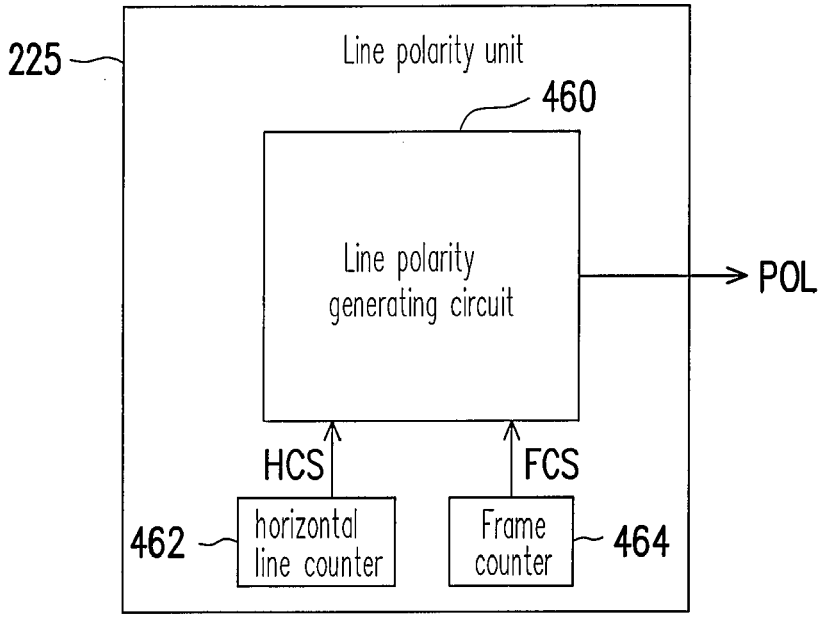
FIG. 4B is a circuit diagram of a line polarity unit according to another embodiment of the present invention.

Next, the circuit architectures of the line polarity unit 225 and the latch signal unit 227 are further illustrated. FIG. 4B is a circuit diagram of a line polarity unit according to another embodiment of the present invention. The line polarity unit 225 comprises a line polarity generating circuit 460, a horizontal line counter 462 and a frame counter 464. The horizontal line counter 462 is electrically connected to the line polarity generating circuit 460 and outputs a horizontal line count signal HCS according to the turn-on timing of the scan lines. The frame counter 464 is electrically connected to the line polarity generating circuit 460 and outputs a frame count signal FCS according to the turn-on timing of the scan lines.

According to the horizontal line count signal HCS and the frame count signal FCS, the line polarity generating circuit 460 outputs a line polarity signal POL to the source driver for controlling the source driver to determine the value of N.

Figure 4C:
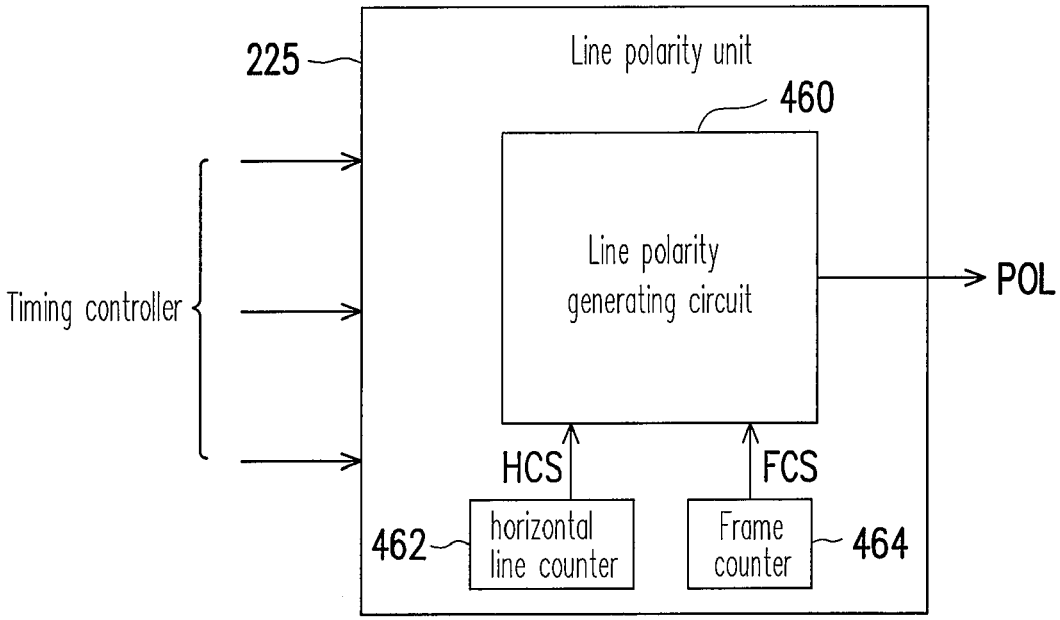
FIG. 4C is a circuit diagram of a line polarity unit according to another embodiment of the present invention.

In another embodiment of the present invention, the line polarity unit 225 can also determine the timing waveform of the line polarity signal POL according to the control signal output by the timing controller. Referring to FIG. 4C, the main difference between FIG. 4C and FIG. 4B is that the line polarity unit 225 is electrically connected to the timing controller and adjusts the timing waveform of the line polarity signal POL according to the output of the timing controller.

Figure 4D:
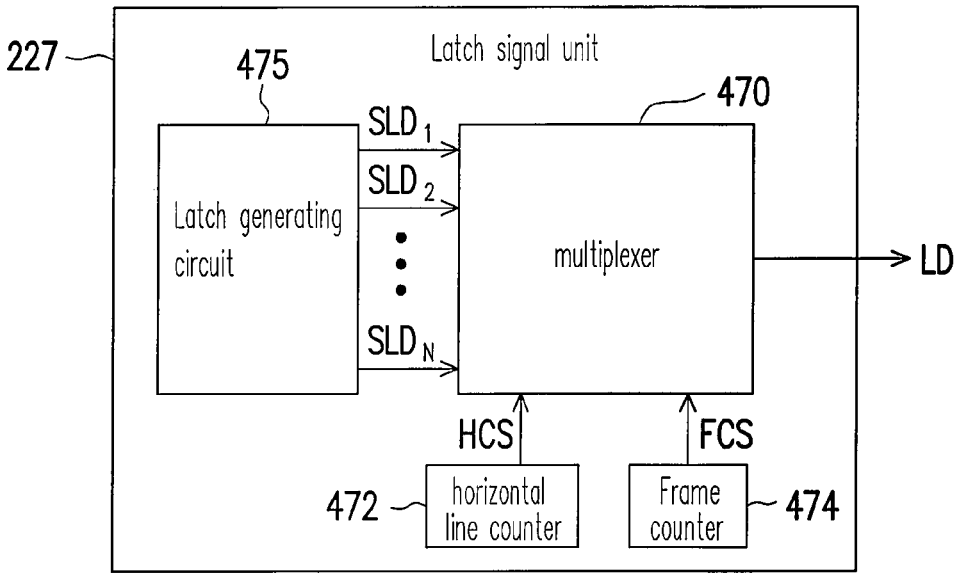
FIG. 4D is a circuit diagram of a latch signal unit according to another embodiment of the present invention.

FIG. 4D is a circuit diagram of a latch signal unit according to another embodiment of the present invention. The latch signal unit 227 comprises a latch generating circuit 475, a multiplexer 470, a horizontal line counter 472 and a frame counter 474. The latch generating circuit 475 outputs a plurality of latch signals $SLD_1$~$SLD_N$ respectively. The multiplexer 470 is electrically connected to the latch generating circuit 475 and receives the latch signals respectively. The horizontal line counter 472 is electrically connected to the multiplexer 470 and outputs a horizontal line count signal HCS according to the turn-on timing of the scan lines. The frame counter 474 is electrically connected to the multiplexer 470 and outputs a frame count signal FCS according to the turn-on timing of the scan lines.

The multiplexer 470 determines the scanning period for each of the scan lines $S_1$~$S_M$ according to the horizontal line count signal HCS and the frame count signal FCS. Accordingly, the multiplexer 470 sequentially switches and outputs the latch signals, thus forming the source data latch signal LD. The source driver 400 determines the charging time for the sub-pixels of each of the scan lines $S_1$~$S_M$ according to the source data latch signal LD. Each latch signal can adjust the timing as desired, such that the sub-pixels of each of the scan lines $S_1$~$S_M$ have different or identical charging time. Thereby, the problem that the pixels of various scan lines have different brightness is solved.

Figure 4E:
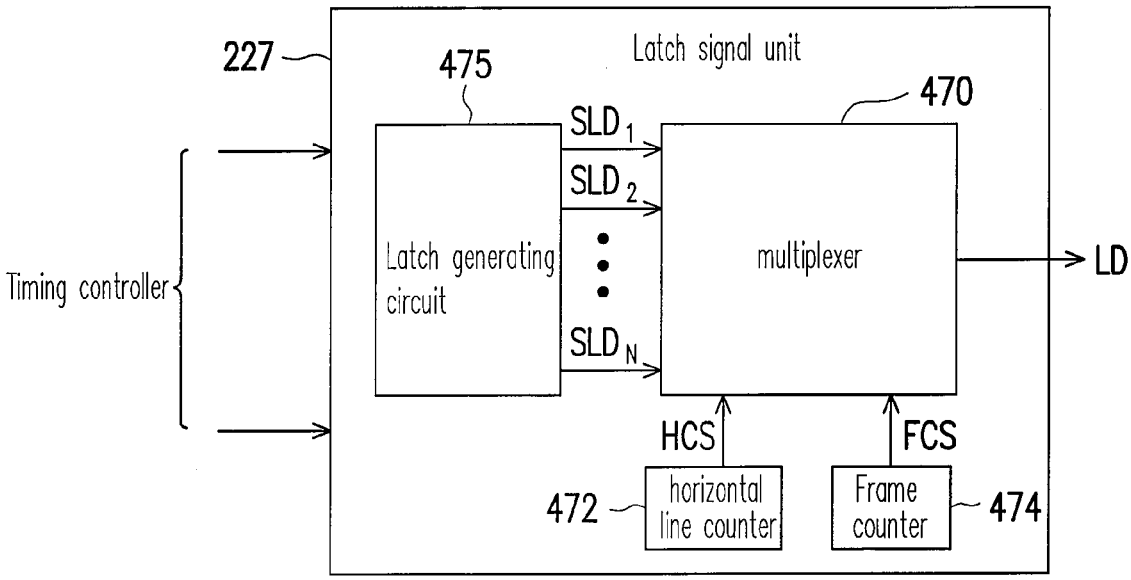
FIG. 4E is a circuit diagram of a latch signal unit according to another embodiment of the present invention.

In another embodiment of the present invention, the latch signal unit 227 can also determine the timing waveform of the source data latch signal LD according to the control signal output by the timing controller. Referring to FIG. 4E, the main difference between FIG. 4E and FIG. 4D is that the latch signal unit 227 is electrically connected to the timing controller and adjusts the timing waveform of the source data latch signal LD according to the control signal output by the timing controller.

Referring to FIG. 5A, a gate controller 500 comprises a shift register 510, a level shifter 520, an output buffer 530 and a gate enabling unit 235. The level shifter 520 is electrically connected between the shift register 510 and the output buffer 530. The gate enabling unit 235 is electrically connected to the output buffer 530. The shift register 510 sequentially generates a plurality of signals according to the gate clock signal GCLK. Then, the signals output by the shift register 510 sequentially turn on the scan lines $S_1$~$S_M$ via the level shifter 520 and the output buffer 530, wherein the output buffer 530 determines the output enabling state according to the gate enabling signal GES output by the gate enabling unit 235. The gate enabling signal GES controls the output enabling state of the output buffer 530, so as to adjust the turn-on time for each of the scan lines $S_1$~$S_M$. Other details of the circuits in FIG. 5A can be easily deduced by those skilled in the art according to the disclosure of the present invention, so they will not be described in detail herein.

Figure 5B:
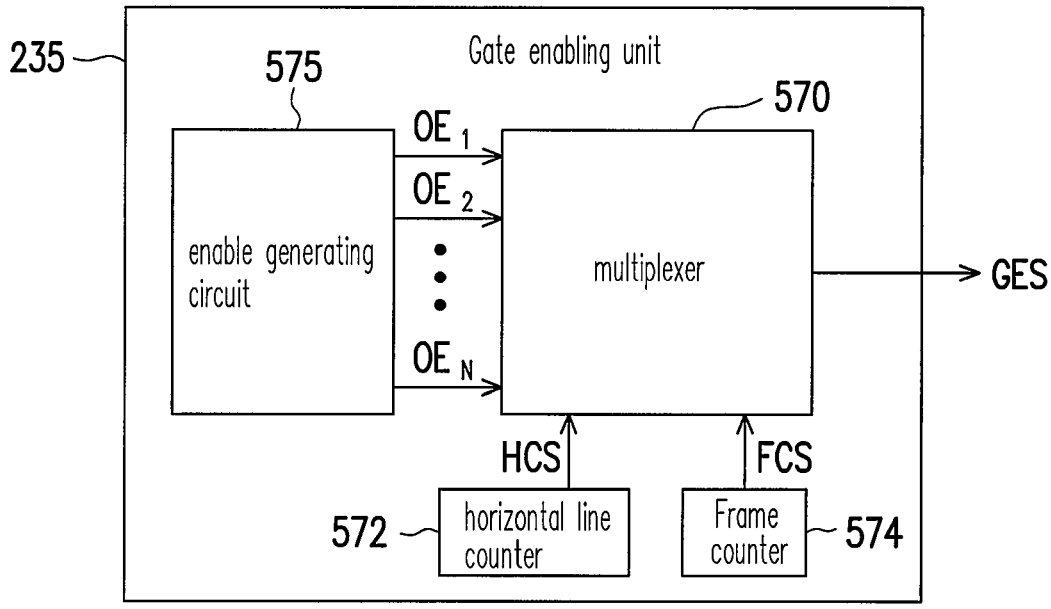
FIG. 5B is a circuit diagram of a gate enabling unit according to another embodiment of the present invention.

FIG. 5B is a circuit diagram of a gate enabling unit according to another embodiment of the present invention. Referring to FIG. 5B, the gate enabling unit 235 comprises an enable generating circuit 575, a multiplexer 570, a horizontal line counter 572 and a frame counter 574. The multiplexer 570 is coupled to the enable generating circuit 575, the horizontal line counter 572 and the frame counter 574 respectively. The enable generating circuit 575 respectively generates a plurality of enabling signals $OE_1$~$OE_N$ to the multiplexer 570. The horizontal line counter 572 and the frame counter 574 respectively output a horizontal line count signal HCS and a frame count signal FCS according to the turn-on timing of the scan lines. According to the above-mentioned horizontal line count signal HCS and frame count signal FCS, the gate enabling unit 235 figures out the turn-on timing of the scan lines. Besides, the multiplexer 570 outputs corresponding enabling signals $OE_1$~$OE_N$ sequentially, so as to form a gate enabling signal GES. The signal GES is used to control the gate driver 500 for determining the turn-on time of each of the scan lines $S_1$~$S_M$.

Figure 5C:
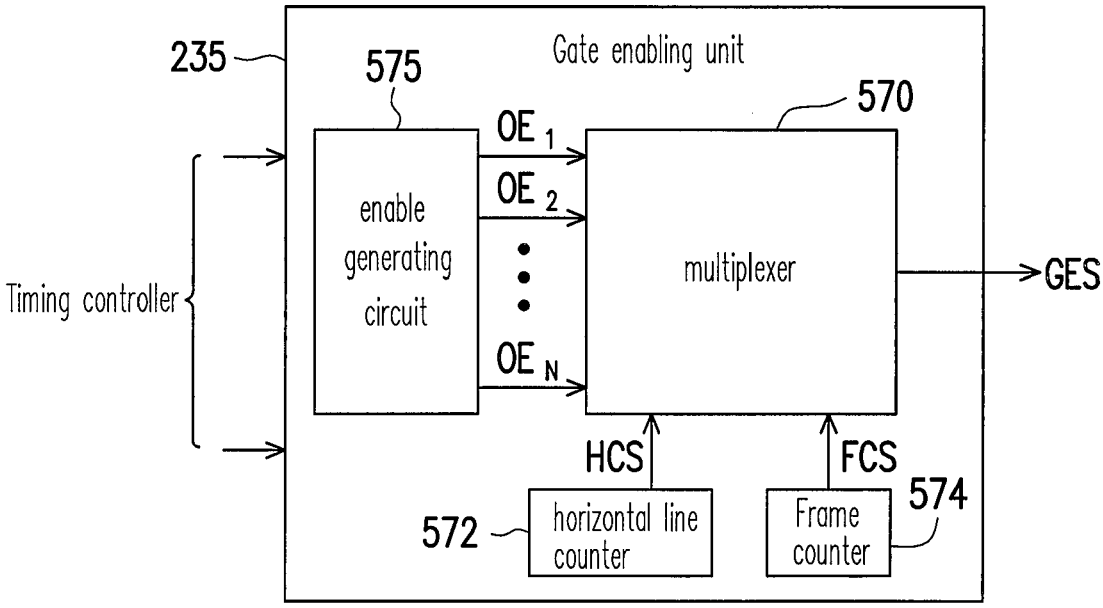
FIG. 5C is a circuit diagram of a gate enabling unit according to another embodiment of the present invention.

In another embodiment of the present invention, the gate enabling unit 235 determines the timing waveform of the gate enabling signal GES according to the control signal output by the timing controller. Referring to FIG. 5C, the main difference between FIG. 5C and FIG. 5B is that the gate enabling unit is electrically connected to the timing controller and adjusts the timing waveform of the gate enabling signal GES according to the control signal output by the timing controller.

Figure 6A:
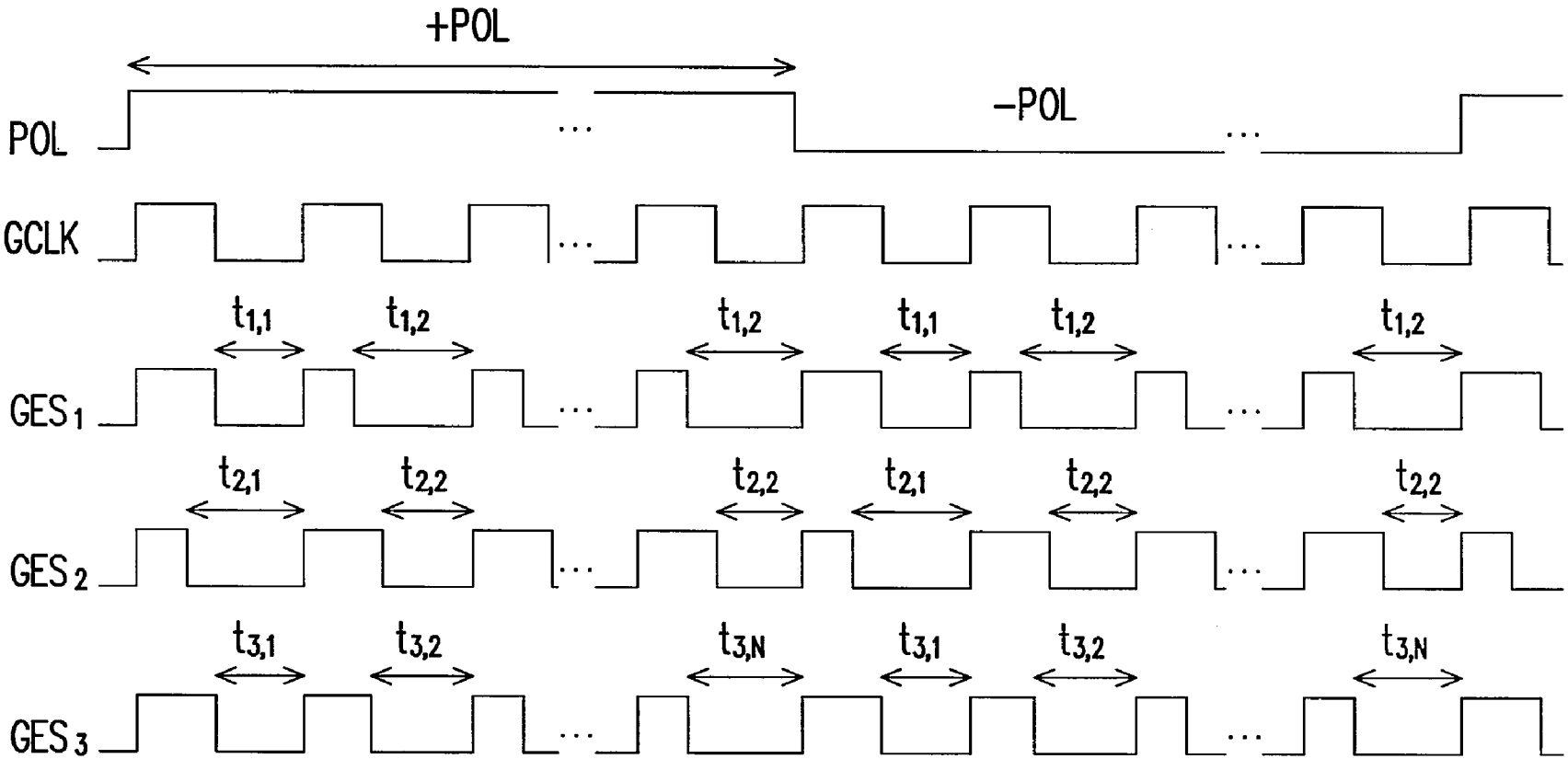
FIG. 6A is a signal waveform chart according to the present embodiment.

Then, the waveform relation between the line polarity signal POL and the gate enabling signal GES is further illustrated. To make those involved in the art understand the technology of the present invention more clearly, the following illustration refers to FIG. 2 at the same time. FIG. 6A is a signal waveform chart according to the present embodiment. Three embodiments of the gate enabling signal GES output by the gate enabling unit 235 are shown in FIG. 6A as $GES_1$, $GES_2$ and $GES_3$. The period of each gate clock signal GCLK represents a set of sub-pixel signals $PS_1$~$PS_i$ are simultaneously output to the corresponding data lines $D_1$~$D_i$. At the same time when the source driver 220 outputs a set of sub-pixel signals $PS_1$~$PS_i$, the gate driver 230 turns on the corresponding scan line (i.e., one of $S_1$~$S_M$), so as to make the pixel signals $PS_1$~$PS_i$ written into the corresponding sub-pixels of the scan line.

Referring to FIG. 6A, the period of the line polarity signal POL is divided into a positive half-period +POL and a negative half-period −POL. When the line polarity signal POL is transformed (i.e., converted from the positive half-period +POL to the negative half-period −POL or from the negative half-period −POL to the positive half-period +POL), the source driver 220 inverts the polarities of the sub-pixel driving signals $PS_1$~$PS_i$. In the positive half-period +POL, the gate driver 230 sequentially turns on N scan lines (N is a positive integer, and $2<N\leqq M$). An enabling period length $t_{1,1}$ of the gate enabling signal $GES_1$ is the turn-on time of the first scan line turned on by the gate driver 230 in the positive half-period +POL. An enabling period length $t_{1,2}$ is the turn-on time for other scan lines turned on by the gate driver 230 in the positive half-period +POL. In the present embodiment, the gate enabling unit 235 utilizes the output gate enabling signal $GES_1$ to adjust the time for the gate driver 230 to turn on each of the scan lines $S_1$~$S_M$. In the positive half-period +POL, the turn-on time $t_{1,1}$ of the first scan line is smaller than the turn-on time $t_{1,2}$ of other scan lines. That is, in the positive half-period +POL, the turn-on time of the first scan line is shorter.

When the line polarity signal POL is transformed from the positive half-period +POL to the negative half-period −POL, the source driver 220 inverts the polarities of the output sub-pixel driving signals $PS_1$~$PS_i$. That is, if the sub-pixel driving signals are of positive polarity in the positive half-period +POL, they are transformed to negative polarity in the negative half-period; on the contrary, if the sub-pixel driving signals are of negative polarity in the positive half-period +POL, they are transformed to positive polarity in the negative half-period −POL. In the negative half-period −POL, the gate driver 230 sequentially turns on N scan lines, and as the operations are similar to those in the positive half-period +POL, they will not be described in detail herein.

In another embodiment, the gate enabling signal GES output by the gate enabling unit 235 is implemented with reference to the gate enabling signal $GES_2$ in FIG. 6A. An enabling period length $t_{2,1}$ of the gate enabling signal $GES_2$ is the turn-on time of the first scan line turned on by the gate driver 230 in the positive half-period +POL (or the negative half-period −POL). An enabling period length $t_{2,2}$ is the turn-on time of other scan lines turned on by the gate driver 230 in the positive half-period +POL (or the negative half-period −POL). In the present embodiment, the gate enabling unit 235 utilizes the output gate enabling signal $GES_2$ to adjust the time for the gate driver 230 to turn on each of the scan lines $S_1$~$S_M$. In the positive half-period +POL (or the negative half-period −POL), the turn-on time $t_{2,1}$ of the first scan line is larger than the turn-on time $t_{2,2}$ of other scan lines. That is, in the positive half-period +POL (or the negative half-period −POL), the turn-on time of the first scan line is longer.

To make the sub-pixels on the scan lines $S_1$~$S_M$ obtain a sufficient charging time, the gate enabling signal GES can have various enabling period lengths, for example, as shown by a gate enabling signal $GES_3$ in FIG. 6A. Each enabling period length $t_{3,1}$~$t_{3,N}$ in the gate enabling signal $GES_3$ can be various depending on the corresponding sub-pixel.

Figure 6B:
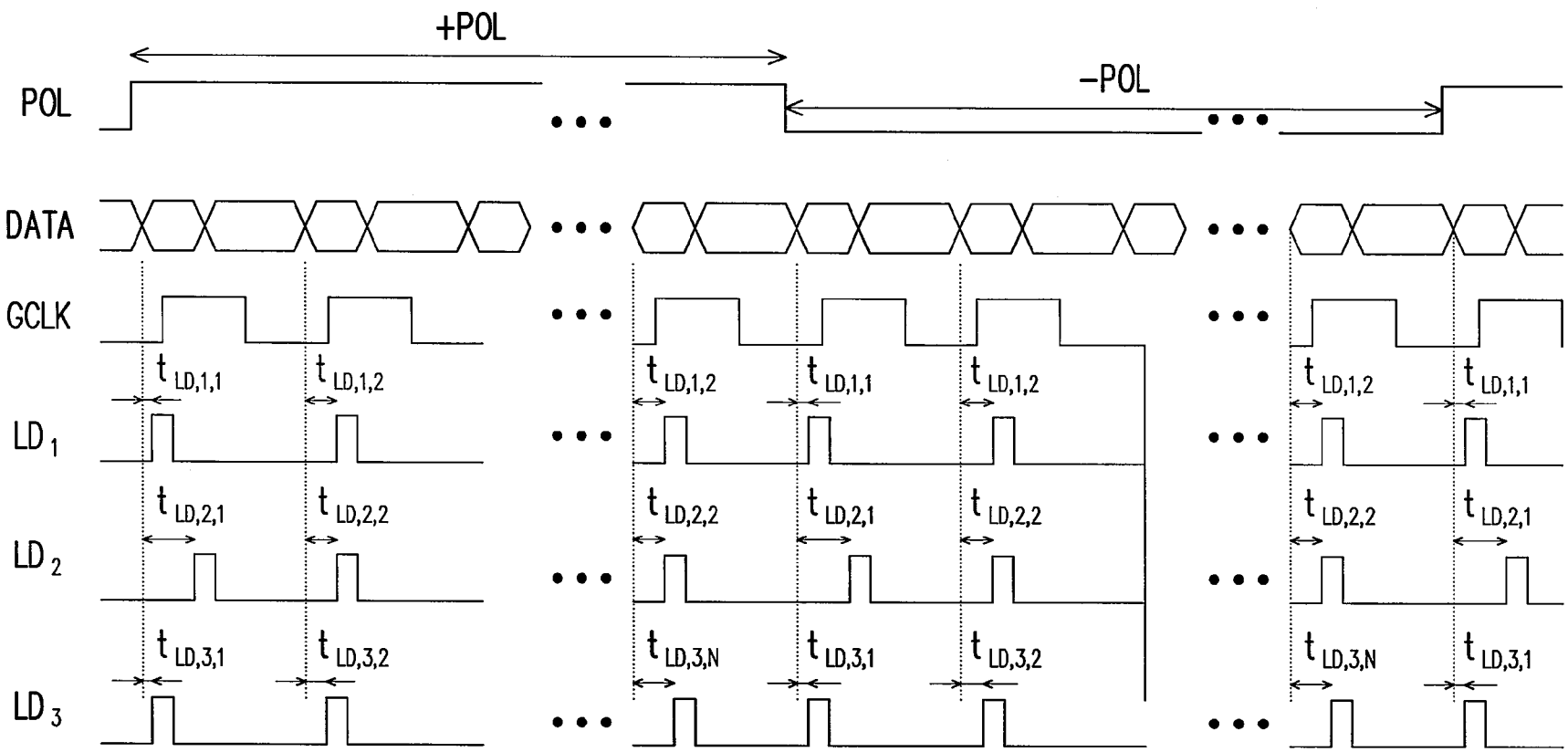
FIG. 6B is a waveform chart of source data latch signals according to another embodiment of the present invention.

In another embodiment of the present invention, the present invention controls the charging time for the sub-pixels on each of the scan lines $S_1$~$S_M$ by adjusting the clock of the source data latch signal LD, so as to avoid obtaining a frame with non-uniform brightness due to unequal charging for the pixels. FIG. 6B is a waveform chart of the source data latch signal according to another embodiment of the present invention. As shown by the timing waveforms of the data signal DATA and the gate clock signal GCLK in FIG. 6B, the period of each gate clock signal GCLK represents a set of sub-pixel signals $PS_1$~$PS_i$ are simultaneously output to the corresponding data lines $D_1$~$D_i$. At the same time when the gate driver 230 turns on the corresponding scan line (i.e., one of $S_1$~$S_M$), the source driver 220 outputs a set of sub-pixel signals $PS_1$~$PS_i$, so as to make the pixel signals $PS_1$~$PS_i$ written into respective sub-pixel of the scan line, and utilizes the clock delay of the source data latch signal LD to adjust the charging time for the sub-pixels on each of the scan lines $S_1$~$S_M$.

FIG. 6B shows three embodiments of the source data latch signal LD output by the latch signal unit 227 as $LD_1$, $LD_2$ and $LD_3$. In the present embodiment, when the source data latch signal LD generates a negative edge triggering (falling edge) signal, the source driver 220 outputs the sub-pixel driving signals $PS_1$~$PS_i$ to the corresponding scan lines $S_1$~$S_M$ for charging the sub-pixels. Thereby, the charging time for the sub-pixels of the scan lines $S_1$~$S_M$ can be controlled by adjusting the delay time of the source data latch signal LD.

Take the source data latch signal $LD_1$ as an example. In a clock period T1, data latch delay time $t_{LD,1,1}$ is the source data latch signal $LD_1$ delay time corresponding to a scan line, i.e., the data latch delay time of the first scan line in the positive half-period +POL. Therefore, the longer the data latch delay time $t_{LD,1,1}$ is, the shorter the charging time for the sub-pixels of the first scan line is. As for the source data latch signal $LD_1$, the data latch delay time $t_{LD,1,1}$ of the first scan line in the positive half-period +POL (or the negative half-period −POL) is smaller than the data latch delay time $t_{LD,1,2}$ of other scan lines. Therefore, if the source data latch signal $LD_1$ is used to latch data for the source driver 220, the charging time for the sub-pixels on the first scan line in the positive half-period +POL (or the negative half-period −POL) is larger than the charging time for the sub-pixels on other scan lines in the positive half-period +POL (or the negative half-period −POL).

Similarly, if the data latch delay time is smaller, the charging time for the sub-pixels of the corresponding scan line is relatively longer. As shown by the source data latch signal $LD_2$, the data latch delay time $t_{LD,2,1}$ is larger than the data latch delay time $t_{LD,2,2}$. Therefore, if the source data latch signal $LD_2$ is used to latch data for the source driver 220, the charging time for the sub-pixels on the first scan line in the positive half-period +POL (or the negative half-period −POL) is smaller than the charging time for the sub-pixels on other scan lines in the positive half-period +POL (or the negative half-period −POL).

To meet the requirements of some specific display panels, each data latch delay time can be different, so as to appropriately adjust the charging time for sub-pixels on the specific scan lines, thereby avoiding obtaining a frame of non-uniform brightness. As shown by the source data latch signal $LD_3$, the data latch delay times $t_{LD,3,1}$~$t_{LD,3,N}$ can have different lengths depending to the corresponding sub-pixels. Other details of FIG. 6B are the same as FIG. 6A, and can be easily deduced by those of ordinary skill in the art, so they will not be described in detail herein.

In the present invention, FIG. 6A and FIG. 6B respectively adjusts the turn-on and charging time of the scan lines by adjusting the gate enabling signal GES and the source data latch signal LD. The main common purpose is to adjust the charging time for the sub-pixels on each scan line, so as to avoid obtaining a frame of non-uniform brightness. The technical means in FIG. 6A and FIG. 6B are controlled by the gate driver 230 and the source driver 220 respectively without conflicting with each other. Therefore, in another embodiment of the present invention, the gate enabling signal GES and the source data latch signal LD are used simultaneously to adjust the charging time for the sub-pixels on the scan lines.

FIG. 7 is a schematic view of a multi-scan line inversion driving method according to the present embodiment. FIG. 7 shows the driving polarity of the sub-pixels in the liquid crystal display panel at a frame T (taking a sub-pixel matrix with sixteen data lines $D_1$~$D_{16}$ as an example), wherein, + represents positive polarity drive, − represents negative polarity drive. Referring to FIGS. 2, 6 and 7, in the present embodiment, the scan lines $S_1$~$S_N$ are all in the positive half-period +POL of the line polarity signal POL, so the scan lines $S_1$~$S_N$ in FIG. 7 have the same driving polarity, and thus the driving polarities of the data lines $D_1$~$D_{16}$ during the turn-on time of the scan lines $S_1$~$S_N$ do not need to be inverted. After N scan lines are sequentially turned on, the line polarity signal POL enters the negative half-period −POL, and the source driver 220 inverts the polarities of the sub-pixel driving signals $PS_1$~$PS_i$ (i.e., changing the driving polarities of the data lines $D_1$~$D_{16}$ in FIG. 7) under the control of the line polarity signal POL, so as to make the driving polarities of the sub-pixels on the scan line $S_{N+1}$ opposite to that of the scan line $S_N$. In the negative half-period −POL of the line polarity signal POL, the driving polarities of the data lines $D_1$~$D_{16}$ on N scan lines $S_{N+1}$~$S_{2N}$ are the same. Likewise, the sub-pixel drive for the whole frame T is completed.

When entering the next frame T+1, the driving polarities of the sub-pixels on each of the scan lines $S_1$~$S_M$ can be opposite to the previous frame T, as shown in FIG. 8. FIG. 8 is a schematic view of the multi-scan line inversion driving method applied to the frame T+1 according to the present embodiment. Referring to FIG. 8, the driving method is similar to the embodiment in FIG. 7, and the main difference there between is that the driving polarities of the data lines $D_1$~$D_{16}$ are different at the very beginning. Those skilled in the art can easily deduce the changes in the driving polarities of the data lines $D_1$~$D_{16}$ according to the disclosure of the present invention, so they will not be described in detail herein.

Figure 9:
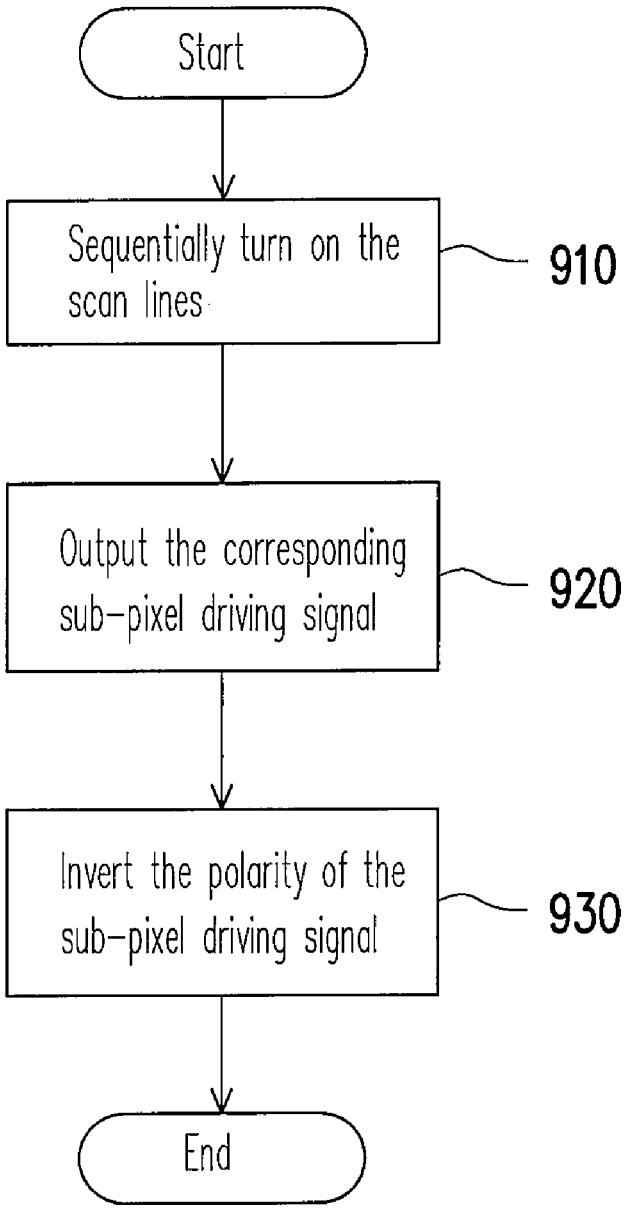
FIG. 9 is a flow chart of a multi-line inversion driving method according to another embodiment of the present invention.

FIG. 9 is a flow chart of a multi-line inversion driving method according to another embodiment of the present invention. The method is suitable for driving a liquid crystal display panel. The liquid crystal display panel comprises M scan lines, wherein M is a positive integer and each scan line corresponds to a plurality of sub-pixels. The multi-line inversion driving method starts from Step 910, wherein the scan lines in the liquid crystal display panel are sequentially turned on. Next, in Step 920, according to the scan lines turned on in Step 910, sub-pixel driving signals are output to the sub-pixels on the scan lines turned on for driving the sub-pixels, wherein each sub-pixel driving signal can be either of positive polarity or negative polarity. Then, entering Step 930, every time after N scan lines are sequentially turned on (N is a positive integer, and $2<N\leqq M$), the polarities of the sub-pixel driving signals $PS_1$~$PS_i$ are inverted (i.e., changing the driving polarities of the data lines $D_1$~$D_i$). After that, repeat Steps 910~930, every time after N scan lines are turned on, the polarities of the sub-pixel signals $PS_1$~$PS_i$ are again inverted till the sub-pixel drive of the liquid crystal display panel is finished. Moreover, every time when the sub-pixel driving signals $PS_1$~$PS_i$ are inverted, the turn-on time of each scan line or the charging time for the sub-pixels on each scan line is adjusted in Step 910, so as to make the sub-pixels have a sufficient charging time. The adjusting manner has been illustrated in detail in the above embodiments, which can be easily deduced by those skilled in the art according to the disclosure of the present invention, so it will not be described in detail herein.

In the present invention, every time after a plurality of scan lines is turned on, the polarities of the sub-pixel driving signals are inverted, so as to significantly lower the driving polarity switching frequency of the data lines, reduce the occurring frequency of large voltage swing and thus reduce the power consumption of the source driver. Meanwhile, the turn-on time of the scan lines is adjusted, so as to make the sub-pixels on each scan line have a sufficient charging time, thereby avoiding the phenomenon of non-uniform brightness of the scan lines due to different charging times.

Though the present invention has been disclosed above by the preferred embodiments, they are not intended to limit the present invention. Anybody skilled in the art can make some modifications and variations without departing from the spirit and scope of the present invention. Therefore, the protecting range of the present invention falls in the appended claims.

What is claimed is:

1. A display driving apparatus, suitable for driving a liquid crystal display panel comprising M scan lines, wherein M is a positive integer and each of the scan lines corresponds to a plurality of sub-pixels, the display driving apparatus comprising:

a gate driver, for sequentially turning on the scan lines;

a source driver, outputting a plurality of sub-pixel driving signals for driving the sub-pixels, wherein each of the sub-pixel driving signals is either of a first polarity or a second polarity;

a latch signal unit, electrically connected to the source driver, for controlling the source driver to determine the charging time for the sub-pixels of each of the scan lines;

wherein, the period that every N scan lines are sequentially turned on by the gate driver is an N-line period, and every time after an N-line period, the source driver inverts the polarity of each of the sub-pixel driving signals, wherein N is a positive integer and $2<N\leqq M$; in each of the N-line periods, a first turn-on time of the first scan line is not equal to a second turn-on time of the second scan line, wherein the first turn-on time or the second turn-on time is controlled by a plurality of latch signals output by the latch signal unit; and a gate enabling unit, electrically connected to the gate driver, for controlling the gate driver to determine the turn-on time of each of the scan lines, wherein the gate enabling unit comprises:

an enable generating circuit, for outputting a plurality of enabling signals respectively;

a multiplexer, electrically connected to the enable generating circuit, for receiving the enabling signals;

a horizontal line counter, electrically connected to the multiplexer, for outputting a horizontal line count signal according to the turn-on timing of the scan lines; and a frame counter, electrically connected to the multiplexer, for outputting a frame count signal according to the turn-on timing of the scan lines;

wherein, the multiplexer sequentially outputs the enabling signals according to the horizontal line count signal and the frame count signal, for controlling the gate driver to determine the turn-on time of each of the scan lines.

2. The display driving apparatus according to claim 1, wherein in each of the N-line periods, the turn-on time of the first scan line is smaller than that of other scan lines.

3. The display driving apparatus according to claim 1, wherein in each of the N-line periods, the turn-on time of the first scan line is larger than that of other scan lines.

4. The display driving apparatus according to claim 1, further comprising:

a line polarity signal unit, electrically connected to the source driver, for controlling the source driver to determine the value of N.

5. The display driving apparatus according to claim 4, wherein the line polarity signal unit comprises:

a line polarity generating circuit;

a horizontal line counter, electrically connected to the line polarity generating circuit, for outputting a horizontal line count signal according to the turn-on timing of the scan lines; and a frame counter, electrically connected to the line polarity generating circuit, for outputting a frame count signal according to the turn-on timing of the scan lines;

wherein, the line polarity generating circuit outputs a line polarity signal to the source driver according to the horizontal line count signal and the frame count signal, for controlling the source driver to determine the value of N.

6. The display driving apparatus according to claim 1, wherein the first polarity is positive and the second polarity is negative.

7. The display driving apparatus according to claim 1, wherein the first polarity is negative and the second polarity is positive.

8. The display driving apparatus according to claim 1, wherein the latch signal unit comprises:

a latch generating circuit, for outputting the latch signals respectively;

a multiplexer, electrically connected to the latch generating circuit, for receiving the latch signals respectively;

a horizontal line counter, electrically connected to the latch generating circuit, for outputting a horizontal line count signal according to the turn-on timing of the scan lines; and a frame counter, electrically connected to the latch generating circuit, for outputting a frame count signal according to the turn-on timing of the scan lines;

wherein, the multiplexer sequentially outputs the latch signals to the source driver according to the horizontal line count signal and the frame count signal, for controlling the source driver to determine the charging time for the sub-pixels of each of the scan lines.

9. The display driving apparatus according to claim 1, wherein the latch signal unit is contained in the source driver.

10. The display driving apparatus according to claim 1, wherein the latch signal unit is contained in a timing controller.

11. The display driving apparatus according to claim 1, wherein the gate enabling unit is contained in the gate driver.

12. The display driving apparatus according to claim 1, wherein the gate enabling unit is contained in the timing controller.

13. A display, comprising:

a liquid crystal display panel comprising M scan lines, wherein M is a positive integer, and each of the scan lines corresponds to a plurality of sub-pixels;

a display driving apparatus, for sequentially turning on the scan lines and correspondingly outputting a plurality of sub-pixel driving signals to drive the sub-pixels, wherein each of the sub-pixel driving signals is either of a first polarity or a second polarity, the display driving apparatus comprises:

a gate enabling unit, electrically connected to the gate driver, for controlling the gate driver to determine the turn-on time of each of the scan lines, the gate enabling unit comprising:

an enable generating circuit, for outputting a plurality of enabling signals respectively;

a multiplexer, electrically connected to the enable generating circuit, for receiving the enabling signals;

a horizontal line counter, electrically connected to the multiplexer, for outputting a horizontal line count signal according to the turn-on timing of the scan lines; and a frame counter, electrically connected to the multiplexer, for outputting a frame count signal according to the turn-on timing of the scan lines;

wherein, the multiplexer sequentially outputs the enabling signals according to the horizontal line count signal and the frame count signal, for controlling the gate driver to determine the turn-on time of each of the scan lines; and a latch signal unit, electrically connected to the display driving apparatus, for controlling the display driving apparatus to determine the charging time for the sub-pixels of each of the scan lines;

wherein, the period that every N scan lines are sequentially turned on by the gate driver is an N-line period, and every time after an N-line period, the display driving apparatus inverts the polarity of each of the sub-pixel driving signals, wherein N is a positive integer and $2<N\leqq M$; in each of the N-line periods, a first turn-on time of the first scan line is not equal to a second turn-on time of the second scan line, wherein the first turn-on time or the second turn-on time is controlled by a plurality of latch signals output by the latch signal unit.

14. The display according to claim 13, wherein the display driving apparatus comprises:

a gate driver, for sequentially scanning the scan lines; and a source driver, outputting the sub-pixel driving signals for driving the sub-pixels.

15. The display according to claim 13, wherein in each of the N-line periods, the turn-on time of the first scan line is larger than that of other scan lines.

16. The display according to claim 13, wherein in each of the N-line periods, the turn-on time of the first scan line is smaller than that of other scan lines.

17. The display according to claim 13, wherein the display driving apparatus further comprises:

a line polarity signal unit, electrically connected to the source driver for controlling the source driver to determine the value of N.

18. The display according to claim 17, wherein the line polarity signal unit comprises:

a line polarity generating circuit;

a horizontal line counter, electrically connected to the line polarity generating circuit, for outputting a horizontal line count signal according to the turn-on timing of the scan lines; and a frame counter, electrically connected to the line polarity generating circuit, for outputting a frame count signal according to the turn-on timing of the scan lines;

wherein, the line polarity generating circuit outputs a line polarity signal to the source driver according to the horizontal line count signal and the frame count signal, for controlling the source driver to determine the value of N.

19. The display according to claim 13, wherein the first polarity is positive and the second polarity is negative.

20. The display according to claim 13, wherein the first polarity is negative and the second polarity is positive.

21. The display according to claim 13, wherein the latch signal unit comprises:

a latch generating circuit, for outputting a plurality of latch signals respectively;

a multiplexer, electrically connected to the latch generating circuit, for receiving the latch signals respectively;

a horizontal line counter, electrically connected to the latch generating circuit, for outputting a horizontal line count signal according to the turn-on timing of the scan lines; and a frame counter, electrically connected to the latch generating circuit, for outputting a frame count signal according to the turn-on timing of the scan lines;

wherein, the multiplexer sequentially outputs the latch signals to the source driver according to the horizontal line count signal and the frame count signal, for controlling the source driver to determine the charging time for the sub-pixels of each of the scan lines.

22. The display according to claim 13, wherein the latch signal unit is contained in the display driving apparatus.

23. The display according to claim 13, wherein the latch signal unit is contained in a timing controller.

24. The display according to claim 13, wherein the gate enabling unit is contained in the gate driver.

25. The display according to claim 13, wherein the gate enabling unit is contained in a timing controller.

* * * * *